US005947882A

United States Patent [19]

Meyer

[11] Patent Number: 5,947,882

[45] Date of Patent: Sep. 7, 1999

[54] BAG-MAKING APPARATUS

[75] Inventor: Armin Meyer, Köln, Germany

[73] Assignee: Lemo Maschinenbau GmbH, Niekderkassel-Mondof, Germany

[21] Appl. No.: 08/941,505

[22] Filed: Sep. 30, 1997

[30] Foreign Application Priority Data

Jul. 3, 1997 [DE] Germany ..... 197 28 371

[51] Int. Cl.[6] ..... B31B 1/64; B31B 49/04

[52] U.S. Cl. ..... 493/194; 493/203; 493/235; 493/239

[58] Field of Search ..... 493/193, 194, 493/195, 196, 198, 199, 200, 201, 202, 203, 204, 227, 235, 223, 239, 340, 361, 362, 242, 372; 53/226, 228

[56] References Cited

U.S. PATENT DOCUMENTS

| | | | |
|---|---|---|---|
| 3,813,998 | 6/1974 | Lotto . | |
| 3,966,524 | 6/1976 | Lehmacher . | |
| 4,128,049 | 12/1978 | Lehmacher . | |
| 4,137,691 | 2/1979 | Takahashi | 53/226 |
| 4,235,695 | 11/1980 | Achelpohl | 493/204 |
| 4,371,365 | 2/1983 | Shingo . | |
| 4,413,463 | 11/1983 | Lancaster | 53/228 |
| 4,452,597 | 6/1984 | Achelpohl | 493/204 |
| 4,487,599 | 12/1984 | Bendig . | |
| 4,490,207 | 12/1984 | Achelpohl . | |
| 4,536,174 | 8/1985 | Dreckmann | 493/204 |
| 4,726,803 | 2/1988 | Lagain | 493/204 |
| 4,764,160 | 8/1988 | Lagain | 493/204 |
| 5,112,289 | 5/1992 | Kohn | 493/204 |
| 5,125,887 | 6/1992 | Attucci | 493/204 |
| 5,282,778 | 2/1994 | Achelpohl | 493/194 |
| 5,312,317 | 5/1994 | Voss | 493/194 |
| 5,362,013 | 11/1994 | Gietman, Jr. et al. . | |

FOREIGN PATENT DOCUMENTS

| | | |
|---|---|---|
| 2428599 | 1/1980 | France . |
| 1901097 | 6/1971 | Germany . |
| 2750392 | 5/1978 | Germany . |
| 2819728 | 11/1979 | Germany . |
| 4214365 | 6/1993 | Germany . |

*Primary Examiner*—Stephen F. Gerrity
*Assistant Examiner*—Eric J. Weierstall
*Attorney, Agent, or Firm*—Herbert Dubno; Andrew Wilford

[57] ABSTRACT

An apparatus for making bags out of a thermoplastic web has a transport unit for feeding a leading end of the web in a transport direction to a cutting/welding station, tools at the station for transversely welding the web and cutting a bag from the leading end of the web, and a device downstream in the direction from the station for stacking and blocking bags cut from the web. A bag-pulling device between the station and the stacker/blocker has an endless drive strand having a pair of stretches extending vertically across a path of the bag between the station and the stacker/blocker and respective horizontally extending deflector rollers carried on the stretches, vertically displaceable therewith, each extending along a respective axis, and each having an outer surface engageable with the web and freely rotatable about the respective axis. A drive can oppositely displace the stretches of the strands and thereby bring the surfaces of the rollers into engagement with opposite faces of the bag so that the bag rolls off the surfaces as the rollers are oppositely displaced without substantial relative movement between the bag and the surface.

9 Claims, 3 Drawing Sheets

BAG-MAKING APPARATUS

FIELD OF THE INVENTION

The present invention relates to a bag-making apparatus. More particularly this invention concerns a bag-pulling subassembly for such an apparatus.

BACKGROUND OF THE INVENTION

A standard bag-making machine has a transport unit for feeding a leading end of the web in a transport direction to a cutting/welding station provided with tools for transversely welding the web and cutting a bag from the leading end of the web. Each such bag cut from the web is stacked and blocked downstream in the direction from the station. A bag-pulling device between the station and the stacker/blocker has an endless drive strand having a pair of stretches extending vertically across a path of the bag between the station and the stacker/blocker. Respective horizontally extending deflector rods carried on the stretches are vertically displaceable therewith, each extend along a respective axis, and each have an outer surface engageable with the web. The stretches of the strand are oppositely displaced to bring the surfaces of the rods into engagement with opposite faces of the bag and thereby pull the bag down and out of the cutter/welder.

Thus once the cutter/welder is closed and pinching the upstream end of the bag, the pulling device can move the bag down to skewer it on heated centering pins of the stacker/blocker while at the same time pulling the upstream end of the bag out of the cutter welder, either just pulling it out from between the jaws or pulling it off the downstream end of the web. During this movement the bag, typically made of a flexible clear thermoplastic like polyethylene, slides over the rod or rods of the pulling device. The friction between the rod and the bag can be sufficient to deform or even tear the bag, and surface imperfections or dirt on the rod can score the bag sliding over it. The solution to this problem is to cycle the machine slowly, but obviously this is not ideal for the mass production of a very cheap consumer item in that it elevates unit cost.

OBJECTS OF THE INVENTION

It is therefore an object of the present invention to provide an improved bag-making apparatus.

Another object is the provision of such an improved bag-making apparatus which overcomes the above-given disadvantages, that is which can run very quickly without damaging the bags being produced.

SUMMARY OF THE INVENTION

An apparatus for making bags out of a thermoplastic web has a transport unit for feeding a leading end of the web in a transport direction to a cutting/welding station, tools at the station for transversely welding the web and cutting a bag from the leading end of the web, and a device downstream in the direction from the station for stacking and blocking bags cut from the web. A bag-pulling device between the station and the stacker/blocker has according to the invention an endless drive strand having a pair of stretches extending vertically across a path of the bag between the station and the stacker/blocker and respective horizontally extending deflector rollers carried on the stretches, vertically displaceable therewith, each extending along a respective axis, and each having an outer surface engageable with the web and freely rotatable about the respective axis. A drive can oppositely displace the stretches of the strands and thereby bring the surfaces of the rollers into engagement with opposite faces of the bag so that the bag rolls off the surfaces as the rollers are oppositely displaced without substantial relative movement between the bag and the surface.

Thus according to this invention there is no appreciable sliding of the bag on the roller or rollers of the pulling device. Instead the outer surface is constructed to rotate easily about its axis, thereby ensuring that the bag will not be unnecessarily stretched and/or scored.

The rollers in accordance with the invention are rods rotatable about the respective axes. More specifically the device further includes a pair of upper drive wheels, a pair of respective lower drive wheels, a pair of the drive strands spaced horizontally from each other and each spanned between a respective one of the upper drive wheels and the respective lower drive wheel. The rods extend between and have ends secured to the respective strands, each roller having a pair of opposite end pins fixed as screws in links of the respective chains.

Each roller according to the invention includes at least one core rod centered on and not generally rotatable about a respective axis and at least one tubular outer rod rotatable about the axis on the respective core rod. The outer rod can be formed by a plurality of coaxial and generally identical tubular rod sections.

In accordance with another feature of the invention each roller further has a pair of generally frustoconical end parts tapering axially toward each other and centered on and rotatable about the respective axis. At least one of the end parts is fixed to the tubular outer rod and at least one of the end parts is fixed to the core rod. Alternately both end sections are fixed to one of the rod parts, normally the outer part, or both are freely rotatable relative to each other and to both of the rod parts.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
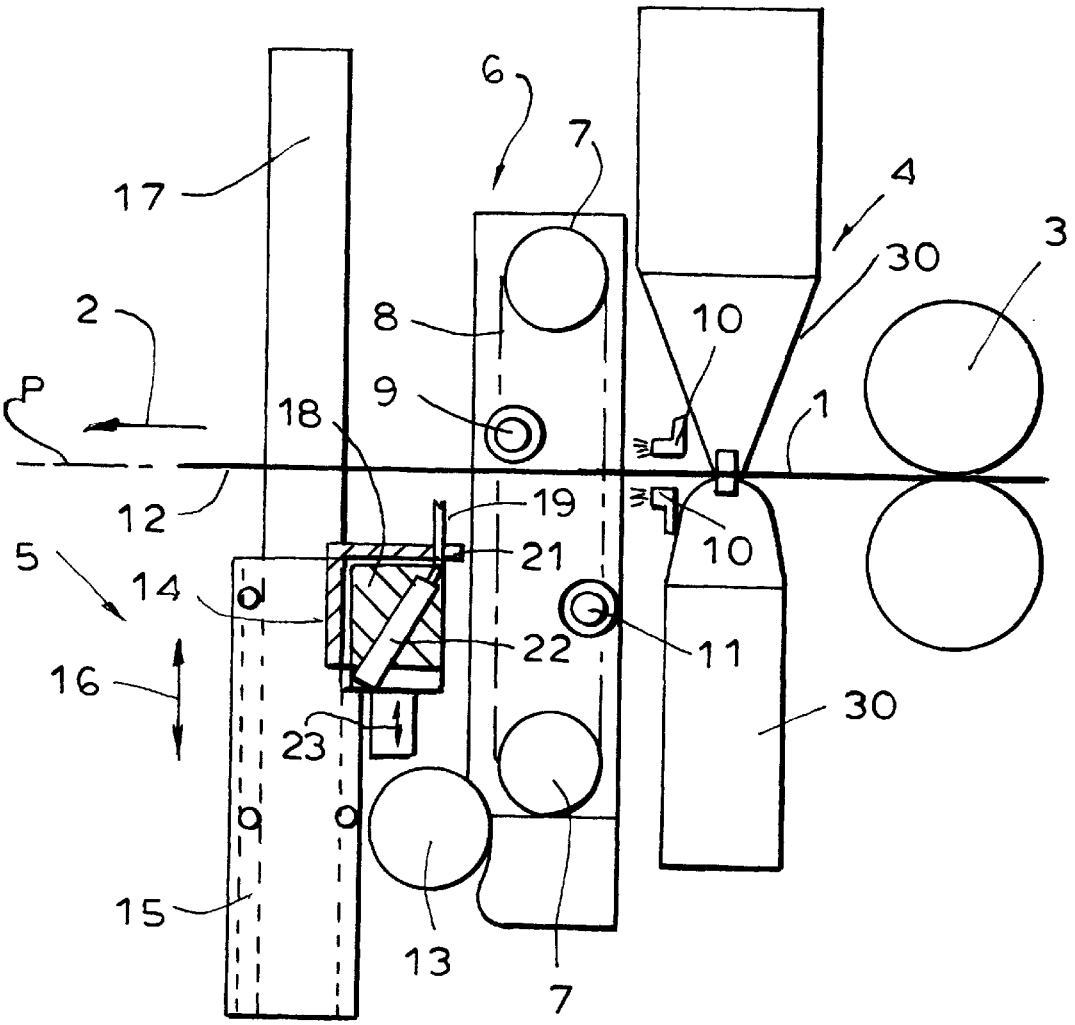
FIG. 1 is a partly diagrammatic side view of the bag-making apparatus according to the invention, in a starting position.

As seen in FIG. 1 a thermoplastic web 1, here a tubular and laterally folded bag blank, is fed in a horizontal transport direction 2 by a pair of upstream feed rollers 3 to a cutting/welding station 4 formed by a pair of vertically oppositely moving heated die cutters or jaws 30 that form a pair of end seams and a crosswise cut or perf line in the web 1 between them. The result is a bag 12 cut from the downstream or leading end of the web 1. Downstream-directed horizontal air jets 10 ensure that even though the free downstream end of the web 1 is unsupported it will move horizontally downstream from the station 4 in the direction 2 generally in a horizontal plane P, even when the jaws 30 are closed together.

Spaced somewhat downstream of the cutting/welding station 4 is a stacking/blocking station 5 that fixes together a stack or block of the bags 12 that hold together sufficiently that they can be packaged and transported. This is typically done by forming small tack welds between parts of the bags that are subsequently torn out. For instance the so-called collar part of an undershirt bag is left in, separated from the rest of the bag by perforations, and these collar parts are welded together so that when one of the bags is pulled loose its collar part is left attached to a clip holding the block of bags.

Thus this stacking/blocking station 5 has a fan 13 whose function is described below as well as a stack support plate 14 that is held on a column 15 movable vertically as shown by arrow 16 by a hydraulic or pneumatic actuator 17. Underneath this support plate 14 is a bar 18 carrying a row of needles 19 passing through holes 21 in the support plate 14 and connected to respective heaters 22. These needles 19 are vertically displaceable as indicated by arrow 23 relative to the support 14 as is well known in the art, so that a finished block of bags can be removed from the station 5 in a manner not relevant to this invention.

The upper surface of the support 14 lies well below the plane P so once a bag 12 is secured on the pins 19 it is out of the way of the next bag to be cut from the web 1 and once the block on the pins 19 is so tall that its topmost bag is almost level with the plane P, the block of bags is removed. Often the perforations between the collar part and balance of the bag are formed at the station 5.

Figure 4:
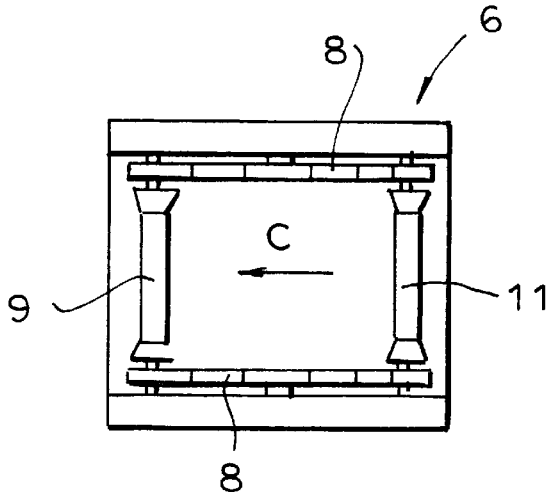
FIG. 4 is a larger-scale top view of a detail of FIG. 3.

Immediately downstream of the cutting/welding station 4 and upstream of the stacking/blocking station 5 is a pulling device 6 according to the invention. It has two coaxial and axially spaced upper wheels 7 and similarly oriented lower wheels 7 with a continuous chain 8 spanned vertically between each upper wheel 7 and the respective lower wheel 7 so that the chains 8 laterally flank the path (see FIG. 4) the bag 12 and web 1 follow in the direction 2. Extending between downstream stretches of the chains 8 is a downstream roller 9 and similarly spanned between its upstream stretches is another such roller 11.

Figure 2:
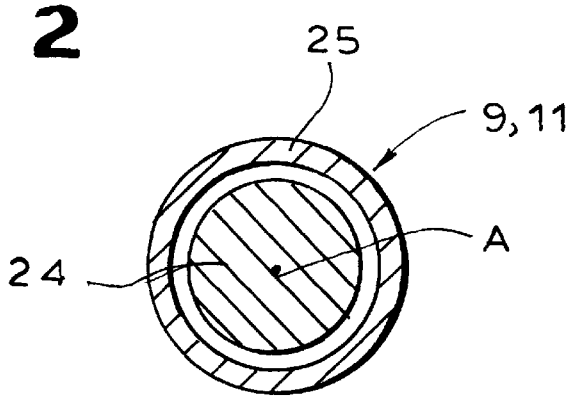
FIG. 2 is a large-scale cross section through a detail of FIG. 1.
Figure 3:
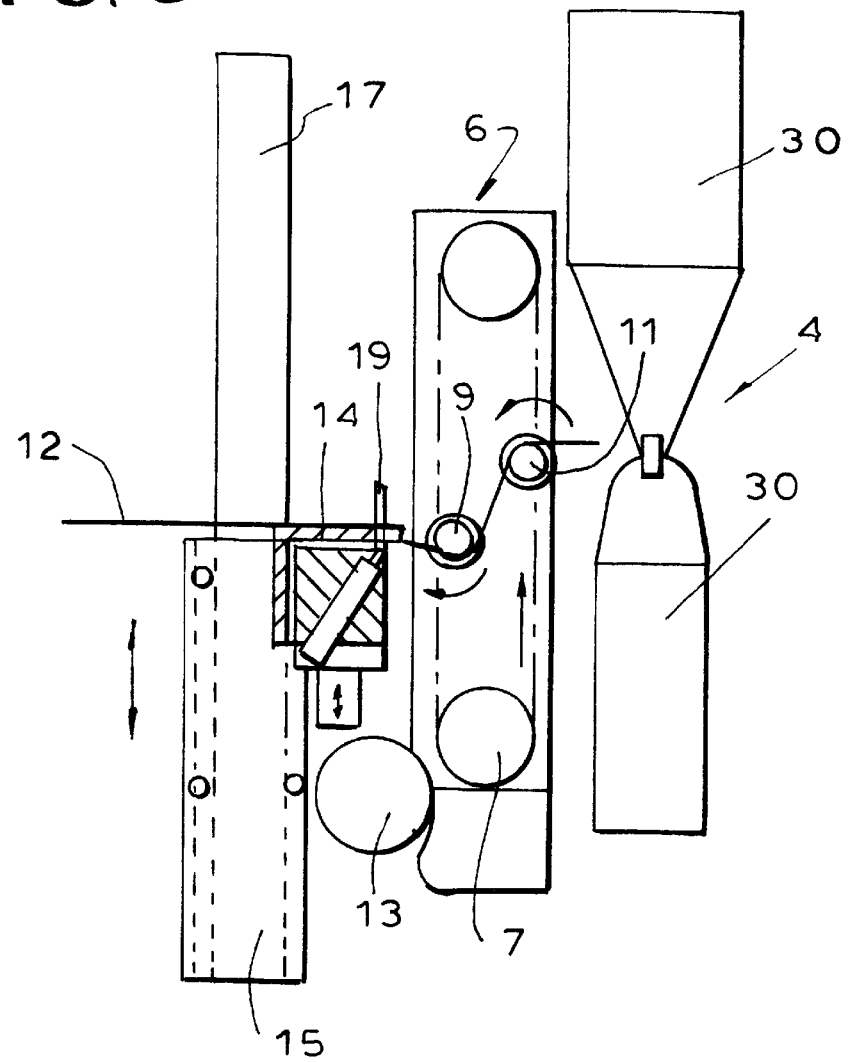
FIG. 3 is a view like FIG. 1 but in an intermediate position.

If the wheels 7 are rotated counterclockwise from the FIG. 2 position, they will bring as shown in FIG. 3 the downstream roller 9 down and the upstream roller 11 up to cross the web'plane P. This will pull the downstream portion of the bag 12 down to skewer it on the heated pins 19 while moving the upstream portion upward to pull it out from between the jaws 30. Normally the action is such that the upstream end of the bag 12 remains held between the jaws 30 or attached to the rest of the web 1 until the downstream portion is caught on the needles 19. Once thus caught, further opposite movement of the rollers 9 and 11 tensions the bag 12 between the needles 19 and the jaws 30 until the upstream end pulls out of the jaws 30, with concomitant sliding of the bag 12 on the rollers 9 and 11.

Figure 5:
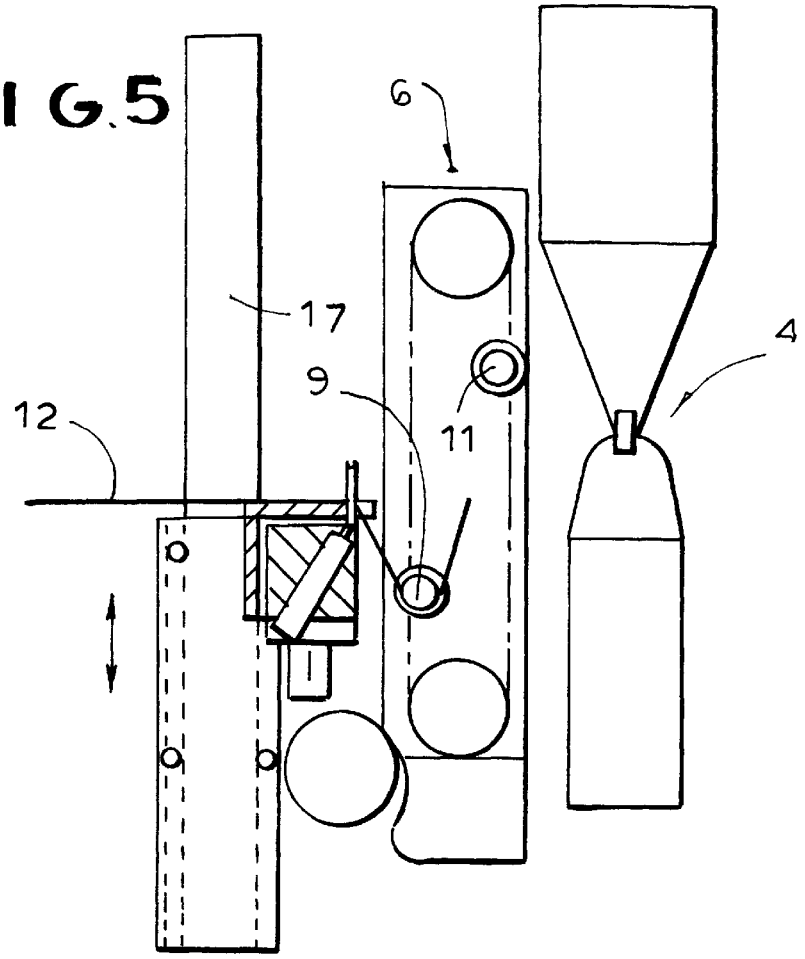
FIG. 5 is a view like FIG. 1 but in an end position.

Once the bag 12 is pulled free of the heating station 4 as shown in FIG. 5 the upstream bag end pulls off the roller 11 and the bag 12 is pulled down by the roller 9 so that it is fed to the fan 13 which flattens it against the top and upstream face of the unillustrated block of bags. Meanwhile of course the jaws 30 open and the wheels 7 reverse so that a new leading end can be fed by the rollers 3 through the station 4, extending straight downstream in the plane P, so that the cycle can be restarted.

In accordance with the invention each of the rollers 9 and 11 is formed as shown in FIG. 2 of an inner rod 24 centered on a respective axis A and at least one tubular outer rod 25 centered on the same axis A. The outer rod or rods 25, as several axially spaced such rods of identical inner and outer diameters can be used, rotate freely on the inner rod 24 so that the upstream end of the bag 5 can roll over it smoothly with no relative movement between the bag and the outer rod 25 which itself will rotate on its inner rod 24. The result is no unnecessary scoring, stretching, or even tearing of the bag which will therefore be pulled much more smoothly out of the stacker/welder 4 and laid on the L-shaped block formed on the support plate 14.

Figure 6:
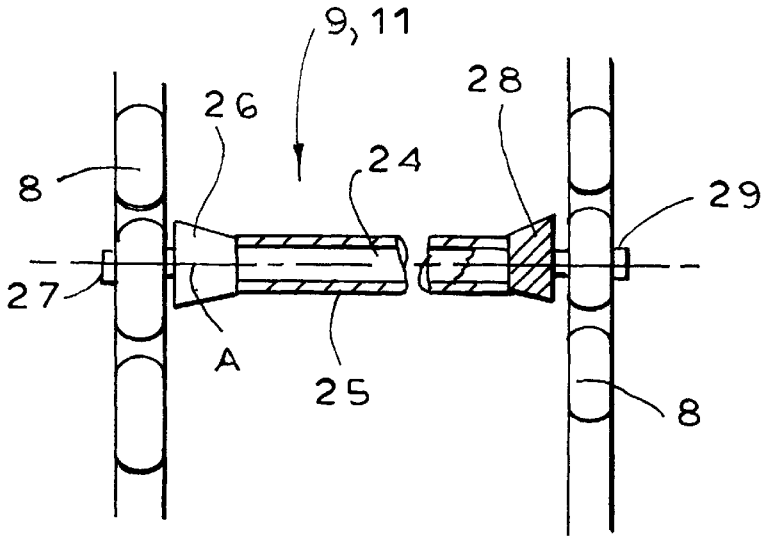
FIG. 6 is a large-scale partly sectional end view of a detail of FIG. 5.

FIG. 6 illustrates the construction of one of the rollers 9 or 11 in more detail. In addition to a central part whose outer surface is formed by one or more outer rods 25, each such roller 9 and 11 has a pair of frustoconical end parts 26 and 28 that taper toward each other and that are centered on the respective axis A. One of the frustoconical end parts 26 can be unitary with the outer rod 25 and carry a pin 27 secured in a link of the respective chain 8 and the other unitary with the core rod 24 and carrying a pin 29 secured in a link of the respective chain 8. Alternately both end parts 28 can rotate freely on the rod 24 like the outer rod or sleeve 25, or both can be fixed to the inner rod 24 or outer rod 25. In any case these end parts 26 and 28 keep the bags 12 centered and allow easy movement of the bags 12 between the rollers 9 and 11. In a simple arrangement one of the end parts 26 can be loose and held in place by the respective screw 27 or 29.

I claim:

1. An apparatus for making bags from a thermoplastic web, the apparatus comprising:

transport means for feeding a leading end of the web in a transport direction to a cutting/welding station and for orienting the leading end horizontally downstream of the cutting/welding station substantially out of contact with any structure;

means at the cutting/welding station for transversely welding the web and cutting a bag from the web;

means downstream in the transport direction from the cutting/welding station for stacking and blocking bags cut from the web; and a bag-pulling device between the cutting/welding station and the blocking and stacking means, the bag pulling device comprising:

an endless drive strand having a pair of stretches extending vertically across a path of the bag between the cutting/welding station and the blocking and stacking means;

respective horizontally extending core rods carried on the stretches, vertically displaceable with the stretches, and each extending along a respective horizontal axis transverse to the transport direction, respective tubular outer rods rotatable about the respective axes on the respective core rods and each having an outer surface engageable with the web and freely rotatable about the respective axis; and means for oppositely displacing the stretches of the strand and thereby bringing the surfaces of the tubular outer rods into engagement with opposite faces of the bag, whereby the bag rolls off the surfaces as the core rods are oppositely displaced without substantial relative movement between the bag and the surfaces.

2. The bag-making apparatus defined in claim 1 wherein the bag-pulling device further includes:

a pair of upper drive wheels;

a pair of respective lower drive wheels;

a pair of the drive strands spaced horizontally from each other and each spanned between a respective one of the upper drive wheels and the respective lower drive wheel, the core rods extending between and having ends secured to the respective drive strands.

3. The bag-making apparatus defined in claim 2 wherein each core rod has a pair of opposite end pins fixed in the respective drive stands.

4. The bag-making apparatus defined in claim 1 wherein the outer rod is formed by a plurality of coaxial and generally identical tubular rod sections.

5. The bag-making apparatus defined in claim 1 wherein each core rod further has a pair of generally frustoconical end parts tapering axially toward each other and centered on and rotatable about the respective axis.

6. The bag-making apparatus defined in claim 1 wherein each tubular outer rod has a pair of generally frustoconical end parts tapering axially toward each other and centered on and rotatable about the respective axis.

7. The bag-making apparatus defined in claim 1 wherein the drive strands are chains.

8. The bag-making apparatus defined in claim 1 wherein the blocking and stacking means includes at least one upwardly directed heated pin positioned to engage the bag as the bag is pulled down by the pulling device.

9. The bag-making apparatus defined in claim 1 wherein the transport means includes at least one horizontally directed air jet immediately downstream of the cutting/welding station below the plane, whereby the leading end is supported on air from the jet.

* * * * *